US011118360B2

(12) United States Patent
Thompson

(10) Patent No.: US 11,118,360 B2
(45) Date of Patent: Sep. 14, 2021

(54) BLOCKOUT ASSEMBLY FOR SUPPORTING CONDUITS THROUGH CONCRETE PANELS

(71) Applicant: Harry A. Thompson, Wyomissing, PA (US)

(72) Inventor: Harry A. Thompson, Wyomissing, PA (US)

( * ) Notice: Subject to any disclaimer, the term of this patent is extended or adjusted under 35 U.S.C. 154(b) by 0 days.

(21) Appl. No.: 16/751,003

(22) Filed: Jan. 23, 2020

(65) Prior Publication Data

US 2021/0230889 A1 Jul. 29, 2021

(51) Int. Cl.

| | |
|---|---|
| ***E04G 15/06*** | (2006.01) |
| ***E04C 3/20*** | (2006.01) |
| ***E04B 5/48*** | (2006.01) |

(52) U.S. Cl.

CPC ..... *E04G 15/061* (2013.01); *E04B 5/48* (2013.01); *E04C 3/20* (2013.01)

(58) Field of Classification Search

CPC ... E04G 15/061; E04G 15/063; E04G 21/185; E04G 21/12; E04B 5/48; E04B 1/4114; E04B 1/4121; E04B 1/4107; E04C 3/20

See application file for complete search history.

(56) References Cited

U.S. PATENT DOCUMENTS 1,285,202 A * 11/1918 Jaques et al. ..... E04B 1/4121 52/699
2,312,338 A * 3/1943 Hulme ..... E04B 1/4107 52/710
3,894,368 A * 7/1975 Crofoot ..... E04G 15/061 52/105
3,908,323 A * 9/1975 Stout ..... E04B 5/326 52/99
4,625,940 A * 12/1986 Barton ..... F16L 5/08 249/157

(Continued)

FOREIGN PATENT DOCUMENTS

EP 1498564 A1 * 1/2005 ..... E04B 1/4107

OTHER PUBLICATIONS

Machine translation of foreign reference EP 1498564, obtained from https://worldwide.espacenet.com/patent/search/family/033462283/publication/EP1498564A1?q=ep1498564 (last accessed on Jan. 27, 2021) (Year: 2021).*

*Primary Examiner* — Theodore V Adamos
(74) *Attorney, Agent, or Firm* — Miller Law Group, PLLC

(57) ABSTRACT

A blockout apparatus, for use in creating passageways through prefabricated concrete structural members, has at least one hanger members integrally molded with the blockout apparatus as a dome projecting above the body of the blockout member that can be used to support conduits inserted through the passageway. A wedge nut can be inserted into the hanger members and twisted to lock the wedge nut in place. The wedge nut can be installed before the blockout apparatus is positioned within the concrete form for the manufacture of the prefabricated concrete structural member, or after the concrete structural member has been formed. Typical usage of the blockout apparatus is to create passageways through the T-Beam of Double-T panels so that conduits can pass through the void corresponding to the blockout apparatus. Mounting devices that support the conduits can be engaged with the wedge nut and provide support for one or multiple conduits.

19 Claims, 11 Drawing Sheets

(56) References Cited

U.S. PATENT DOCUMENTS

| | | | | |
|---|---|---|---|---|
| 5,245,806 | A * | 9/1993 | Baur | E04G 15/061 52/127.3 |
| 5,623,804 | A * | 4/1997 | Kelly | E04B 1/4107 52/704 |
| 5,625,993 | A * | 5/1997 | Kelly | E04B 1/4107 52/506.05 |
| 8,915,038 | B1 * | 12/2014 | Whitcomb, Sr. | E04G 15/063 52/576 |
| 9,347,213 | B1 * | 5/2016 | Zhang | E04C 3/08 |
| 9,580,920 | B1 * | 2/2017 | Yingling | E04G 15/061 |
| 2004/0165947 | A1 * | 8/2004 | Herb | F16B 39/282 403/374.3 |
| 2007/0039281 | A1 * | 2/2007 | Zambelli | E04B 1/4107 52/710 |
| 2011/0291323 | A1 * | 12/2011 | Grasser | E04C 3/20 264/278 |
| 2014/0283475 | A1 * | 9/2014 | Zhang | E04B 1/1903 52/578 |
| 2015/0047276 | A1 * | 2/2015 | Gandolfo | H02G 3/22 52/220.8 |
| 2016/0017593 | A1 * | 1/2016 | Magee | E04G 15/04 52/699 |
| 2017/0121963 | A1 * | 5/2017 | Jablonsky | E04B 1/4114 |
| 2019/0210316 | A1 * | 7/2019 | Kuhmann | B32B 3/18 |
| 2020/0141108 | A1 * | 5/2020 | Mazzola Vernengo | E04F 11/1812 |

* cited by examiner

BLOCKOUT ASSEMBLY FOR SUPPORTING CONDUITS THROUGH CONCRETE PANELS

FIELD OF THE INVENTION

The invention disclosed in this application is directed generally to the construction of prefabricated concrete structural members, and more particularly to a tubular blockout member inserted into the forms for the concrete structural members to create openings for then passage and support of conduits through the structural members.

BACKGROUND OF THE INVENTION

The present invention is generally directed to a blockout apparatus for double-tee concrete structural members, such as the concrete panels used in constructing parking garages. In such structures, there is typically a need to provide conduits for supporting electrical wires, water lines, and other utility lines without disrupting the structure of the concrete panels. To accomplish this function, blockout members have been provided to be integrated into the concrete form before pouring the concrete mixture so that once the concrete is hardened, there is an opening available through the "T-section" of the concrete panel for the passage of conduits therethrough.

Various prefabricated structural members formed of concrete or other such materials known in the art are widely used in various applications. As noted above, a typical example of such a prefabricated concrete structural member is the "Double-T" panel used to construct parking garages. These Double-T panels generally include a planar top panel and a pair of integral vertical beams formed underneath the top panel to project vertically downward therefrom, thus giving the structural member the Double-T name. In the construction of parking garages, as an example, a number of these concrete Double-T panels are assembled together so that the planar top panels form a floor for an elevated level over which cars can traverse. The vertical concrete beams become oriented in a row to define supporting joist structures for planar top panels.

A tubular blockout member is incorporated into the T-beams of a Double-T concrete panel in U.S. Pat. No. 9,580,920, granted to Jeffrey Yingling on Feb. 28, 2017. This blockout member includes a transversely extending hanger members inserted into a void formed in the blockout member at each respective end thereof. Mounting devices are supported from the hanger members to hold conduits transversely spaced along the underside of the blockout member across the top portion thereof. With the cutouts in the upper portion of the Yingling blockout member, the opening had to be covered with the hanger members or at least a separate block, which causes difficulties with uncured concrete leaking around the hanger members and into the cavity of the blockout member.

Thus, when the prefabricated concrete Double-T panels are formed, the block out is inserted into the form to create an opening through the T-beam sections once the concrete has cured. Conduits carrying utilities and for other purposes can pass through the openings created by the blockout members, but building codes require the support of such conduits from stable structure. To accomplish this supporting function, contractors would drill holes into the concrete of the Double-T panels to insert fasteners from which mounting devices, such as mechanical hangers, can be installed to support the conduits. The Yingling patent provided an alternative apparatus for supporting conduits, but this apparatus carries challenges with respect to sealing the opening in the blockout member.

Accordingly, it would be desirable to provide a blockout member that provides an improved apparatus for supporting conduits passing through the blockout member after the Double-T panel has been installed and forms a part of a concrete structure.

SUMMARY OF THE INVENTION

It is an object of this invention to overcome the difficulties of the prior art by providing a blockout apparatus having integral hanger members for supporting conduits passing through the blockout apparatus.

It is another object of this invention to provide a blockout apparatus used to create openings through concrete structural members during the formation of the concrete structural members in which the blockout apparatus has integrally formed hanger members.

It is a feature of this invention that the hanger members are integrally formed with the molding of the blockout apparatus.

It is an advantage of this invention that the integral formation of the dome portion of the blockout apparatus carrying the hanger members prevents leakage of uncured concrete into the blockout apparatus while the concrete structural member is being formed.

It is another feature of this invention that the dome portion is longitudinally oriented with respect to the major axis of the opening through the blockout apparatus.

It is another advantage of this invention that the dome portion carrying the hanger members has a smaller profile than the known prior art blockout apparatus.

It is still another object of this invention to provide a mechanism associated with a blockout apparatus having integral hanger members to provide support for the passage of conduits through the blockout apparatus installed in a concrete structural member.

It is still another feature of this invention that the hanger members cooperate with a wedge nut to provide support with a mounting device supporting conduits passing through the hanger members.

It is still another advantage of this invention that the wedge nut is installed into the hanger members from below the hanger members by insertion and twisting the wedge nut into position on the hanger members.

It is yet another advantage of this invention that the wedge nut can be installed into the hanger members without disrupting the integrity of the blockout apparatus or the dome portions housing the hanger members.

It is yet another feature of this invention that the wedge nut can be installed into the hanger members of the blockout apparatus before or after the blockout apparatus is installed into the concrete form for making the concrete structural member.

It is still another object of this invention to provide a blockout apparatus with a novel appearance compared to existing blockout apparatus.

It is still another feature of this invention that the hanger members are formed as an integral dome portion oriented longitudinally and located along the transverse center of the blockout apparatus.

It is a further feature of this invention that the blockout apparatus with integral dome portion can be used in the construction of Double-T panels to create a void within the T-beams for the passage of conduits therethrough.

It is a further object of this invention to provide a blockout apparatus for use in the manufacture of prefabricated concrete structural members, which is durable in construction, inexpensive of manufacture, carefree of maintenance, facile in assemblage, and simple and effective in use.

These and other object, features and advantages are accomplished in the instant invention by providing a blockout apparatus for use in creating passageways through prefabricated concrete structural members having at least one hanger members integrally molded with the blockout apparatus as a dome projecting above the body of the blockout member that can be used to support conduits inserted through the passageway. A wedge nut can be inserted into the hanger members and twisted to lock the wedge nut in place. The wedge nut can be installed before the blockout apparatus is positioned within the concrete form for the manufacture of the prefabricated concrete structural member, or after the concrete structural member has been formed. Typical usage of the blockout apparatus is to create passageways through the T-Beam of Double-T panels so that conduits can pass through the void corresponding to the blockout apparatus. Mounting devices that support the conduits can be engaged with the wedge nut and provide support for one or multiple conduits.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
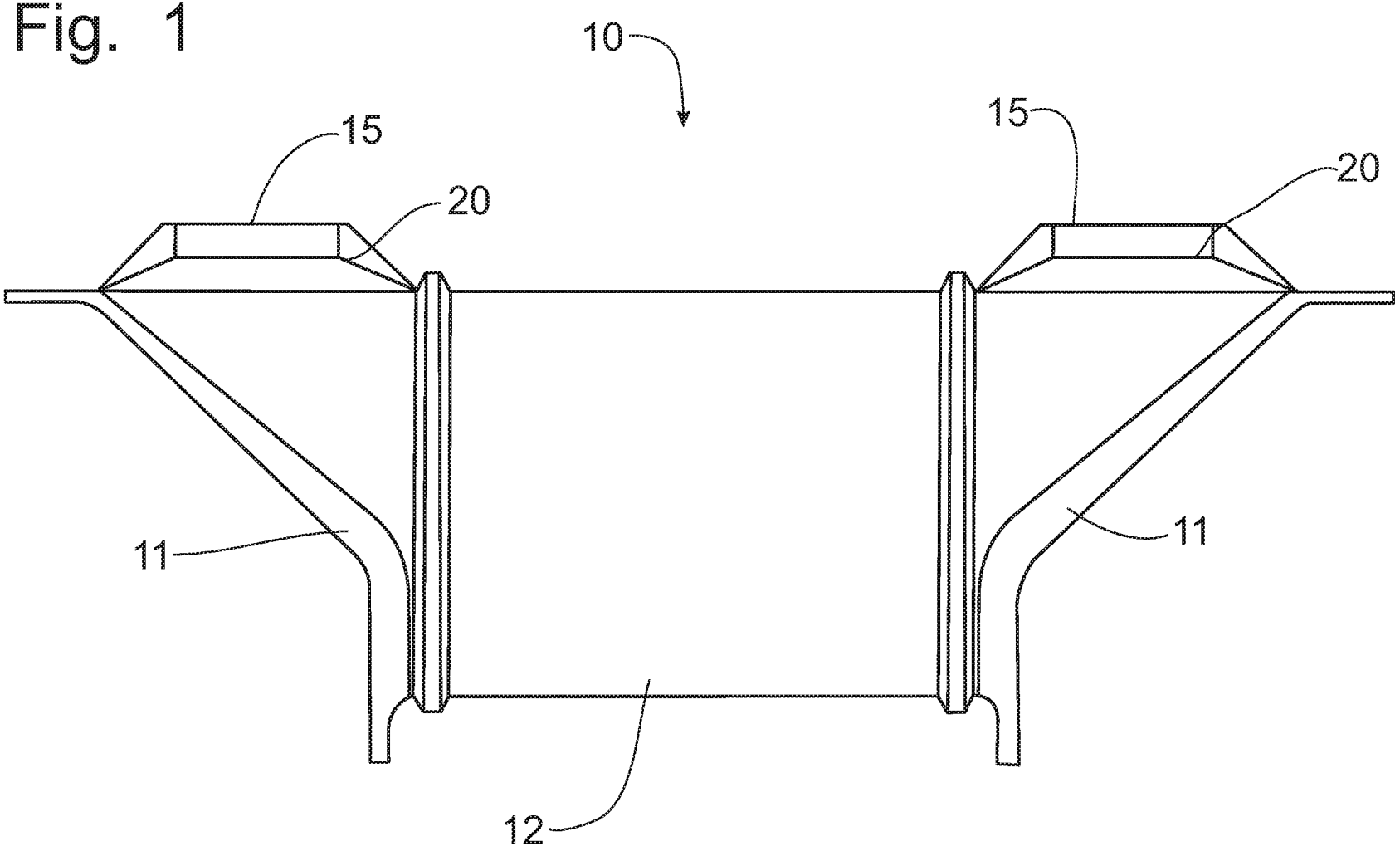
FIG. 1 is a side elevational view of a blockout apparatus incorporating the principles of the instant invention.
Figure 2:
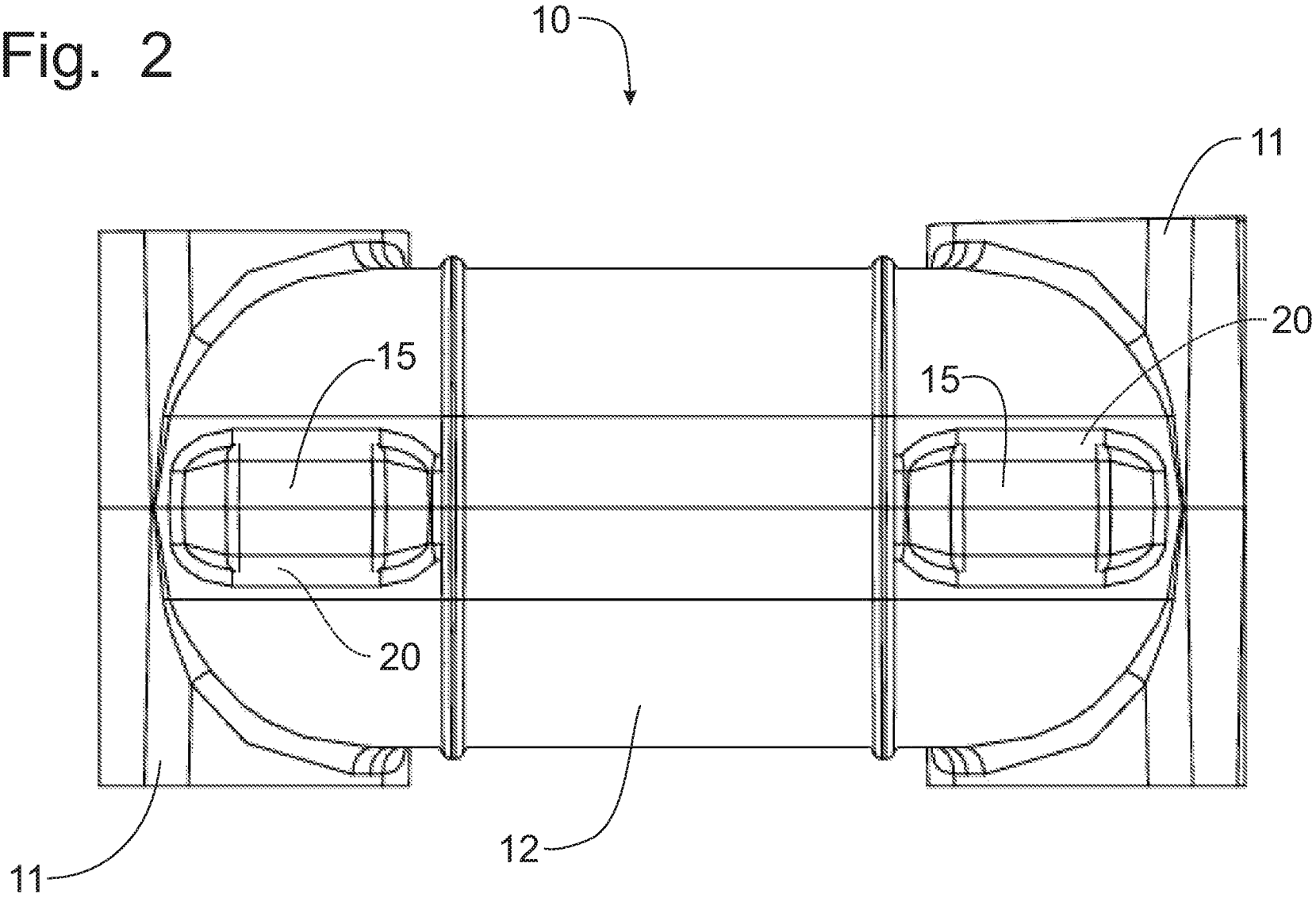
FIG. 2 is a top plan view of the blockout apparatus shown in FIG. 1.
Figure 3:
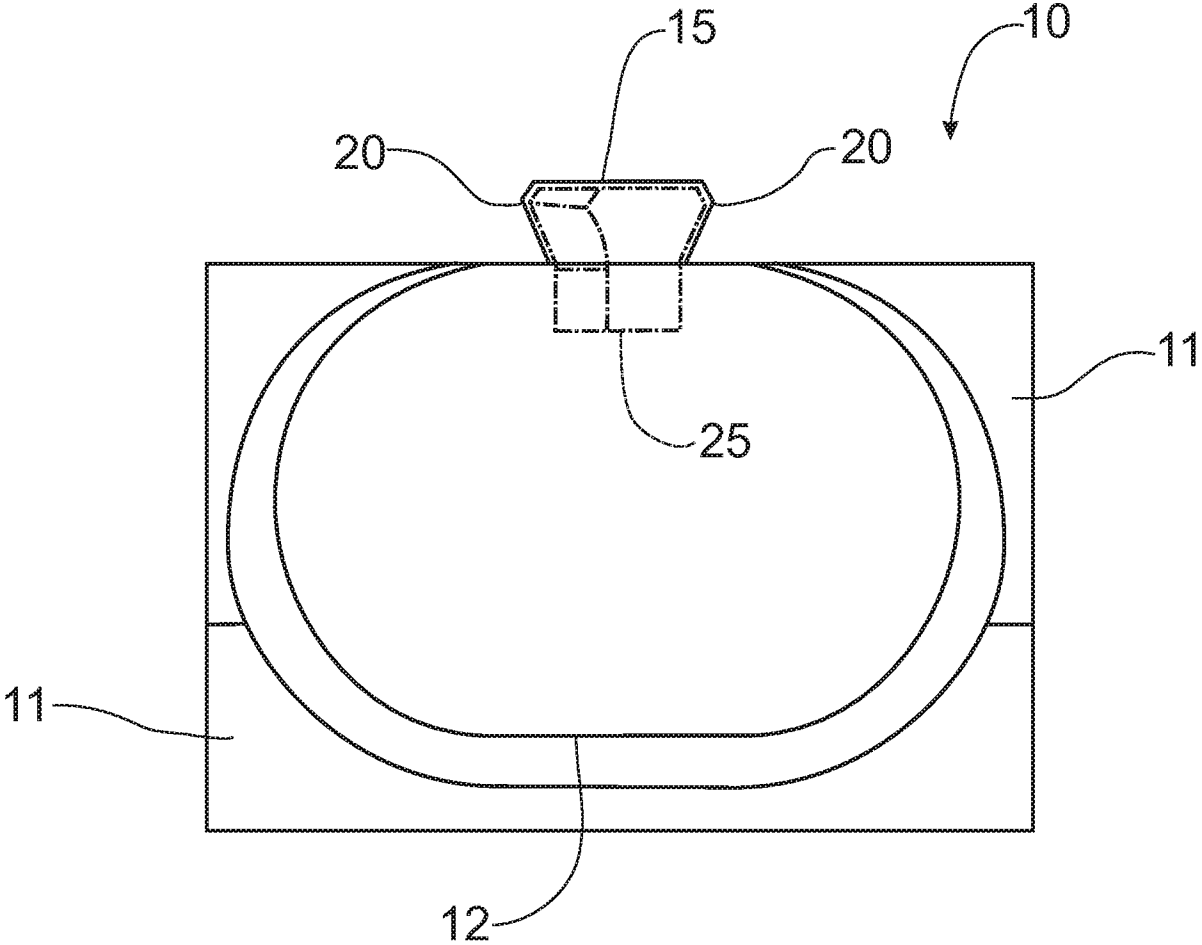
FIG. 3 is an end view of the blockout apparatus depicted in FIG. 1, a wedge nut engaged with the hanger members being shown in phantom.

Referring to FIGS. 1-3, a blockout apparatus 10 incorporating the principles of the instant invention can best be seen. The blockout apparatus 10 is intended for installation into the molding form of a prefabricated concrete structure, such as a Double-T concrete panel used in the construction of parking garages, as an example depicted in FIG. 8, to create a passageway, or a void, through the concrete structure in order to allow solid objects to pass through the concrete structure, such as conduits. More specifically, the blockout apparatus 10 is installed into the molding form before pouring an uncured concrete mixture in the form so that when the concrete mixture hardens the blockout apparatus 10 defines an opening through a portion of the prefabricated concrete structural member, such as through the T-beams.

Figure 8:
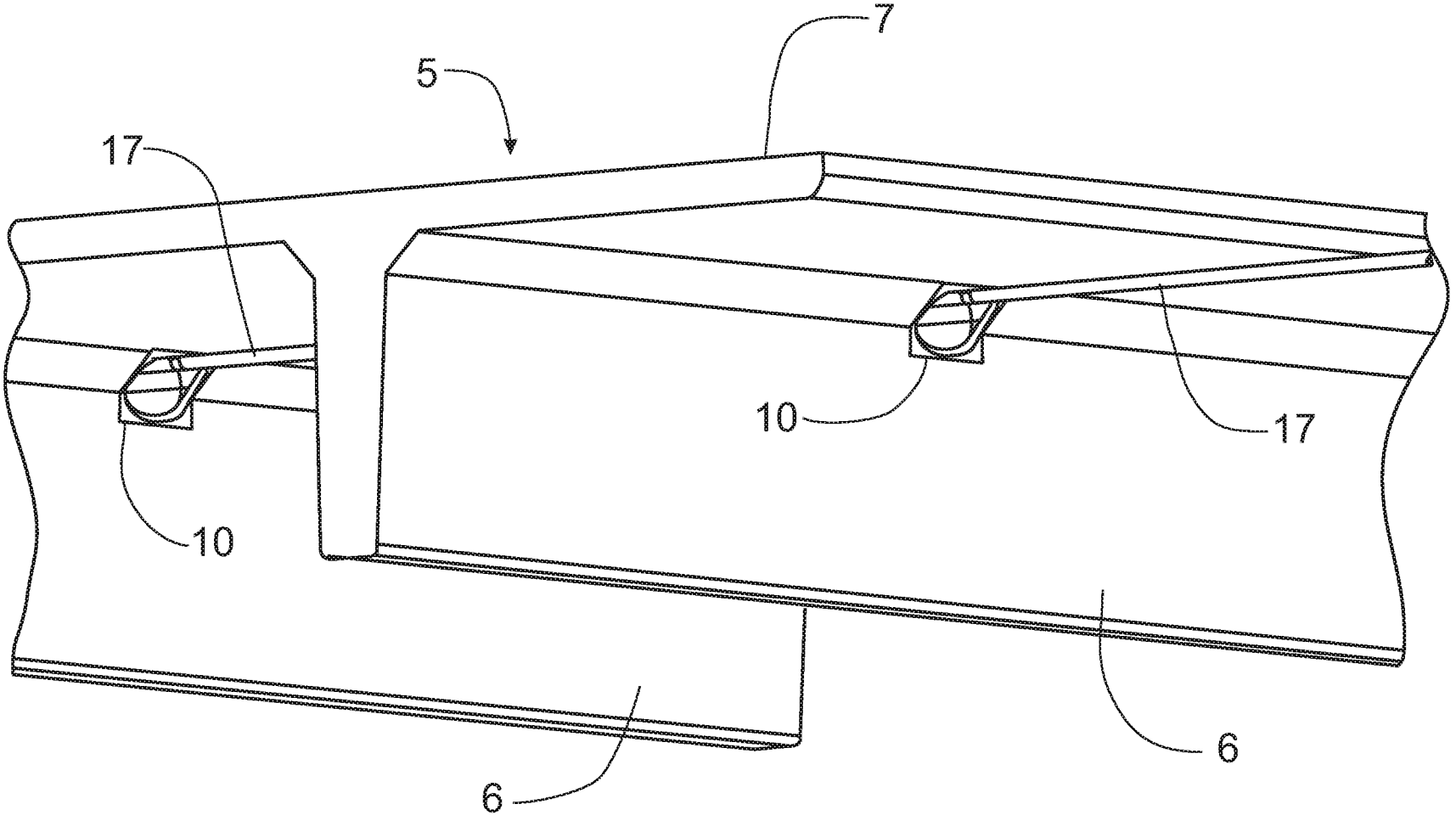
FIG. 8 is a perspective view of a portion of a Double-T prefabricated concrete panel with blockout members installed in both T-beams and having a conduit passing through the aligned blockout members to depict a typical use of the blockout members in conjunction with pre-formed concrete members.

The blockout apparatus 10 is preferably molded from plastic into a tubular body member 12 with flanges 11 at the opposing ends thereof to mate with the molding form for the prefabricated concrete structural member so that the blockout apparatus 10 becomes an integral part of the prefabricated concrete structural member. The typical use of the blockout apparatus 10 is shown in FIG. 8 as forming a passageway through the T-beams 6 of a Double-T concrete panel 5. Since these passageways extend through the T-beams, conduits 17 can be supported from the underside of the Double-T panel and pass through the voids or passageways created by the blockout apparatus 10.

To permit the mounting of the conduits 17 by the blockout apparatus 10, the blockout apparatus 10 is formed with dome portions 15 on at least one end of the blockout apparatus 10, and preferably at both opposing ends of the blockout apparatus 10. Each dome portion 15 provides an extended height of the blockout apparatus 10 in order to have sufficient physical structure for forming hanger members 20 in the upper part of the blockout apparatus 10 that can be used to support conduits 17. As best seen in FIGS. 3 and 5-7, the hanger members 20 are formed in a manner to permit engagement with a wedge nut 25, as will be described in greater detail below, which connect with a mounting device 30 for engagement and support of the conduits 17. Preferably, the conduit(s) can be supported by mounting devices 30 provided only in the blockout apparatus 10 to eliminate any need for drilling holes into the underside of the Double-T panel to install supplemental mounting devices.

Figure 4A:
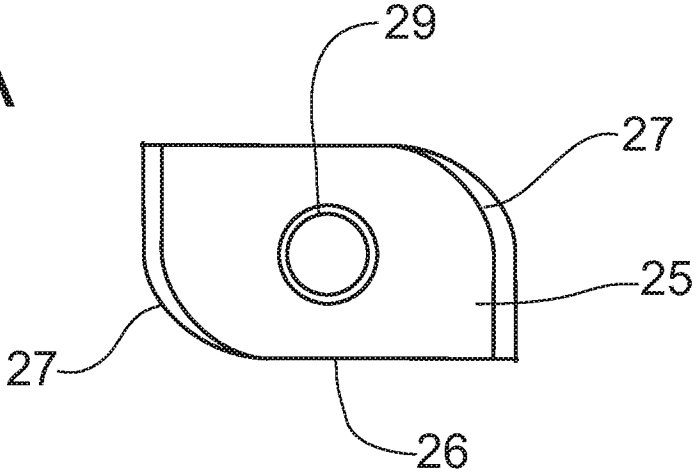
FIG. 4A is a top plan view of a representative wedge nut.
Figure 4B:
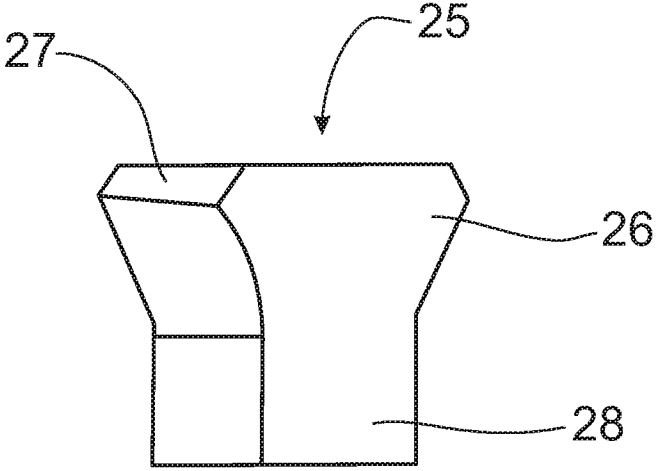
FIG. 4B is a side elevational view of the wedge nut shown in FIG. 4A.
Figure 4C:
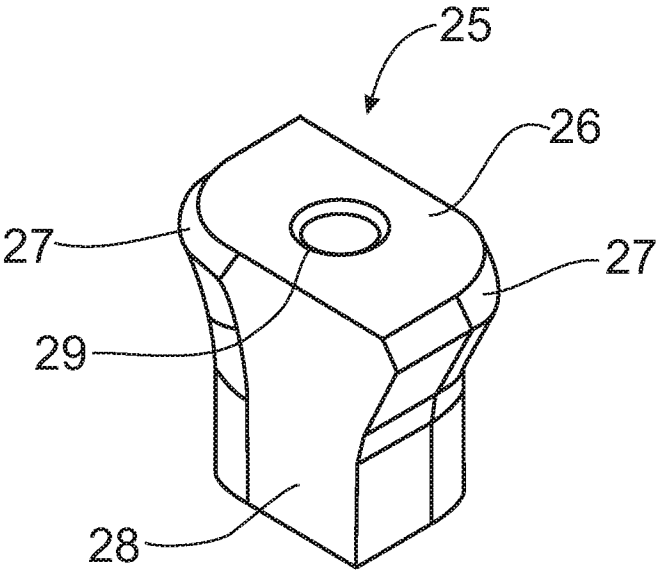
FIG. 4C is a perspective view of the wedge nut shown in FIGS. 4A and 4B.

The hanger members 20 are integrally formed as part of the dome portion 15 during the molding of the blockout apparatus 10. Accordingly, the installation of the wedge nut 25 into the hanger members 20 is all that remains to be accomplished in order to provide the necessary support for a mounting device 30 that can engage and support the conduits 17. The wedge nut 25 is best seen in FIGS. 4A through 4C and includes an enlarged head 26 and a tapered lower portion 28. The enlarged head 26 has a curved portion 27 on opposing corners to facilitate the twisting and locking of the wedge nut 25 into position on the hanger members 20. At least one threaded opening 29 passes vertically through wedge nut 25 for engagement with the mounting device 30, as described in greater detail below. The wedge nut 25 can include multiple threaded openings 29, for example two or three openings 29, for multiple mounting devices that will support multiple conduits 17 passing through the blockout member 10.

The wedge nut 25 is preferably installed after the prefabricated concrete panel 5 has been released from the molding form in which the blockout apparatus 10 had been installed to create a void or passageway through the concrete panel 5. However, the wedge nut 25 can be installed shortly after the blockout apparatus 10 is released from the mold in which the blockout member is formed, so that the wedge nut 25 is included with the blockout apparatus 10 when the blockout apparatus 10 is positioned into the molding form for fabricating the Double-T panel 5. By delaying the installation of the wedge nut 25 until needed to support conduit(s) 17, the installer can select a specific configuration of the wedge nut 25 as desired for the specific use thereof.

To install the wedge nut 25, the wedge nut 25 is inserted into the dome portion 15 in a longitudinal orientation and then twisted into engagement with the hanger members 20 through a rotation of approximately ninety degrees to lock the enlarged head 26 of the wedge nut 25 into engagement with the hanger members 20. At this point in time, the wedge nut 25 is not movable relative to the hanger members 20 and the mounting device 30 can be threaded into the wedge nut 20 for engagement therewith. After the wedge nut 25 is installed, the tapered lower portion 28 can extend slightly into the void formed by the blockout member 10 to facilitate engagement thereof for attachment of the mounting device 30. Once the wedge nut 25 has been installed, removal of the wedge nut 25 from engagement with the hanger members 20 is difficult to achieve because of the square corners of the enlarged head 26 opposite the curved portions 27.

Figure 5:
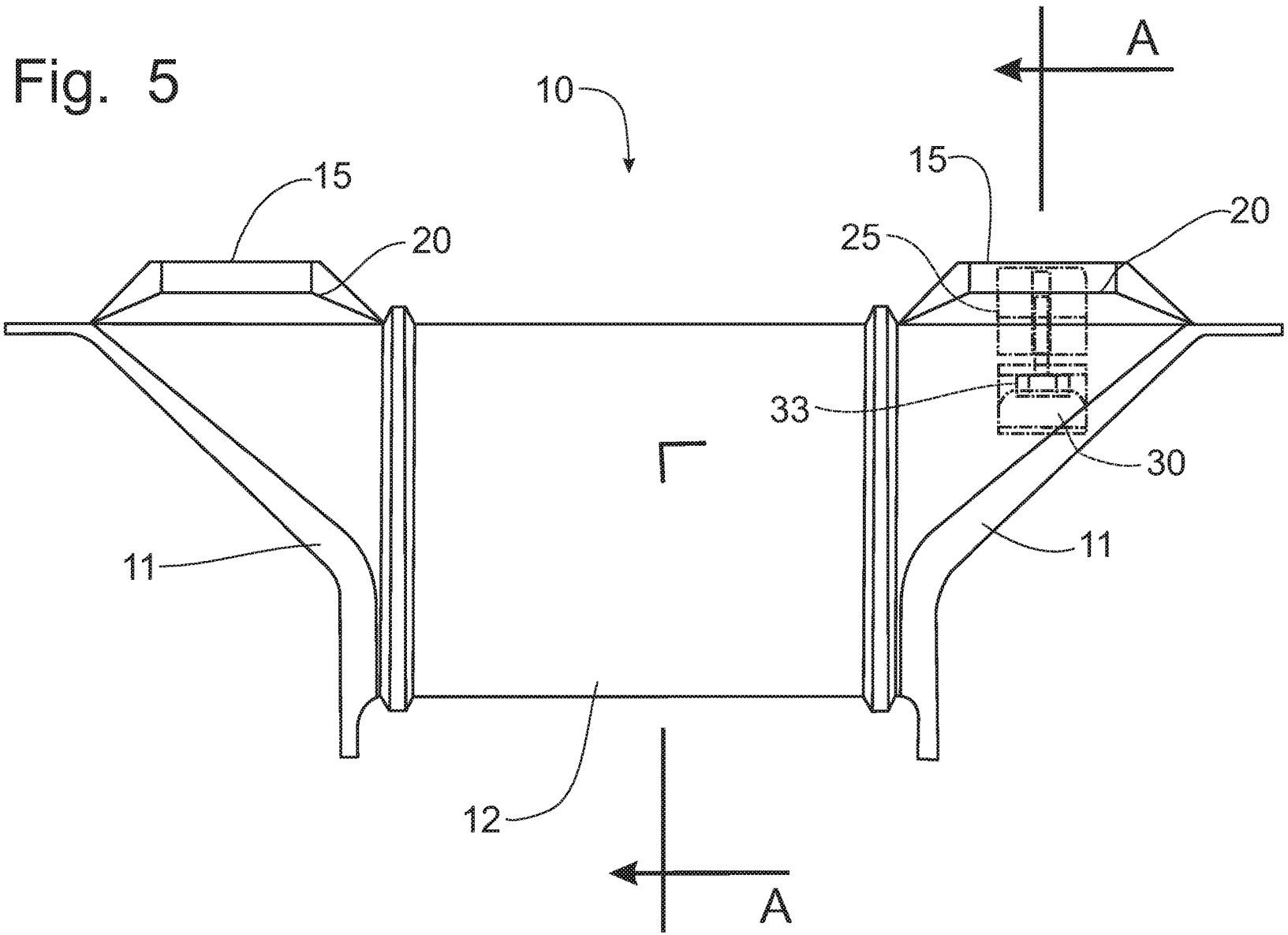
FIG. 5 is a side elevational view of the blockout apparatus similar to FIG. 1, but having a wedge nut installed in the hanger members at one end thereof and a mounting apparatus engaged with the wedge nut for the support of a conduit, the wedge nut and mounting apparatus being shown in phantom.
Figure 6:
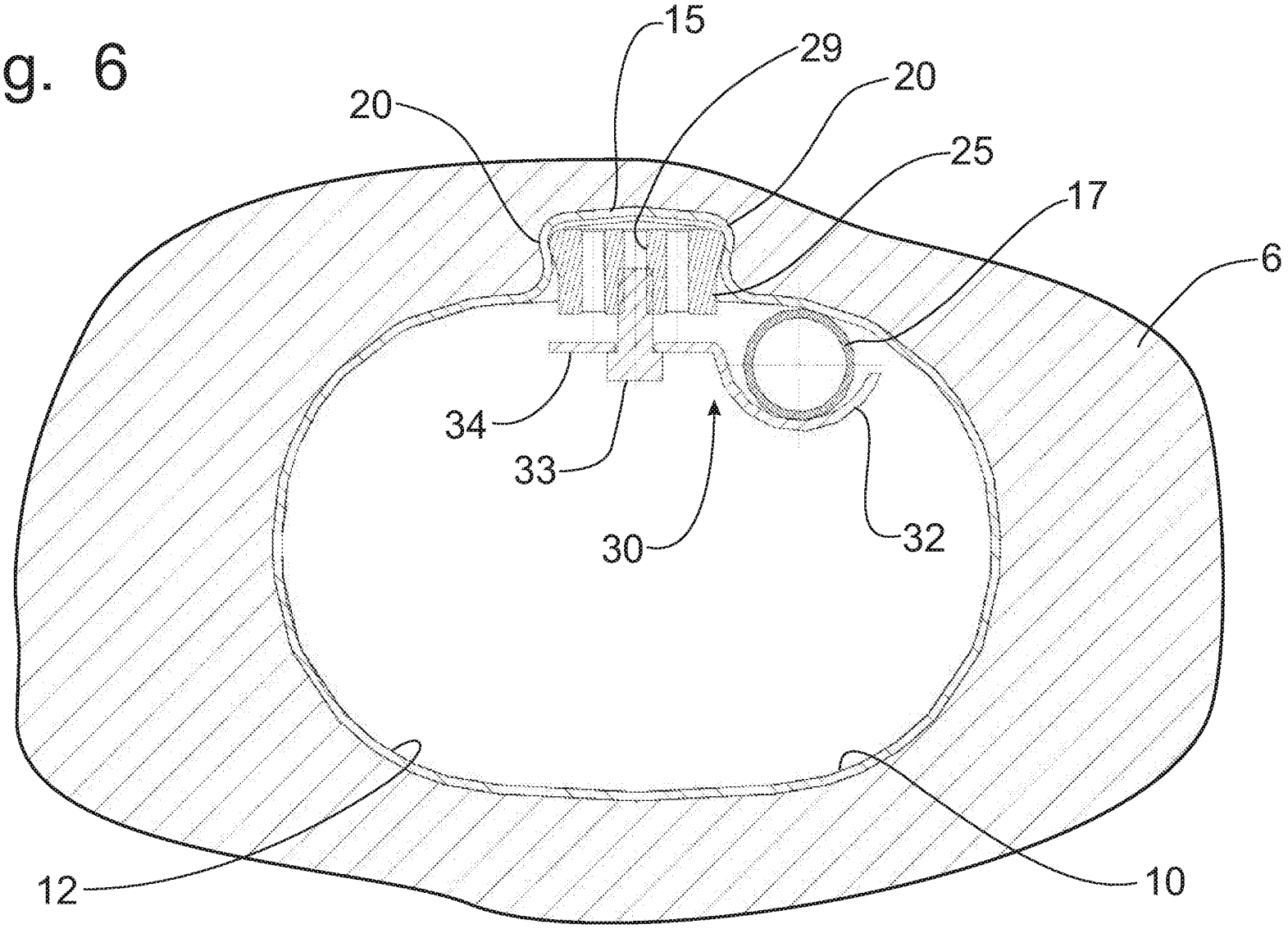
FIG. 6 is a cross-sectional view of the blockout member taken along lines A-A of FIG. 5 to show the positioning of a representative mounting device for supporting a conduit passing through the void created by the blockout member.
Figure 7:
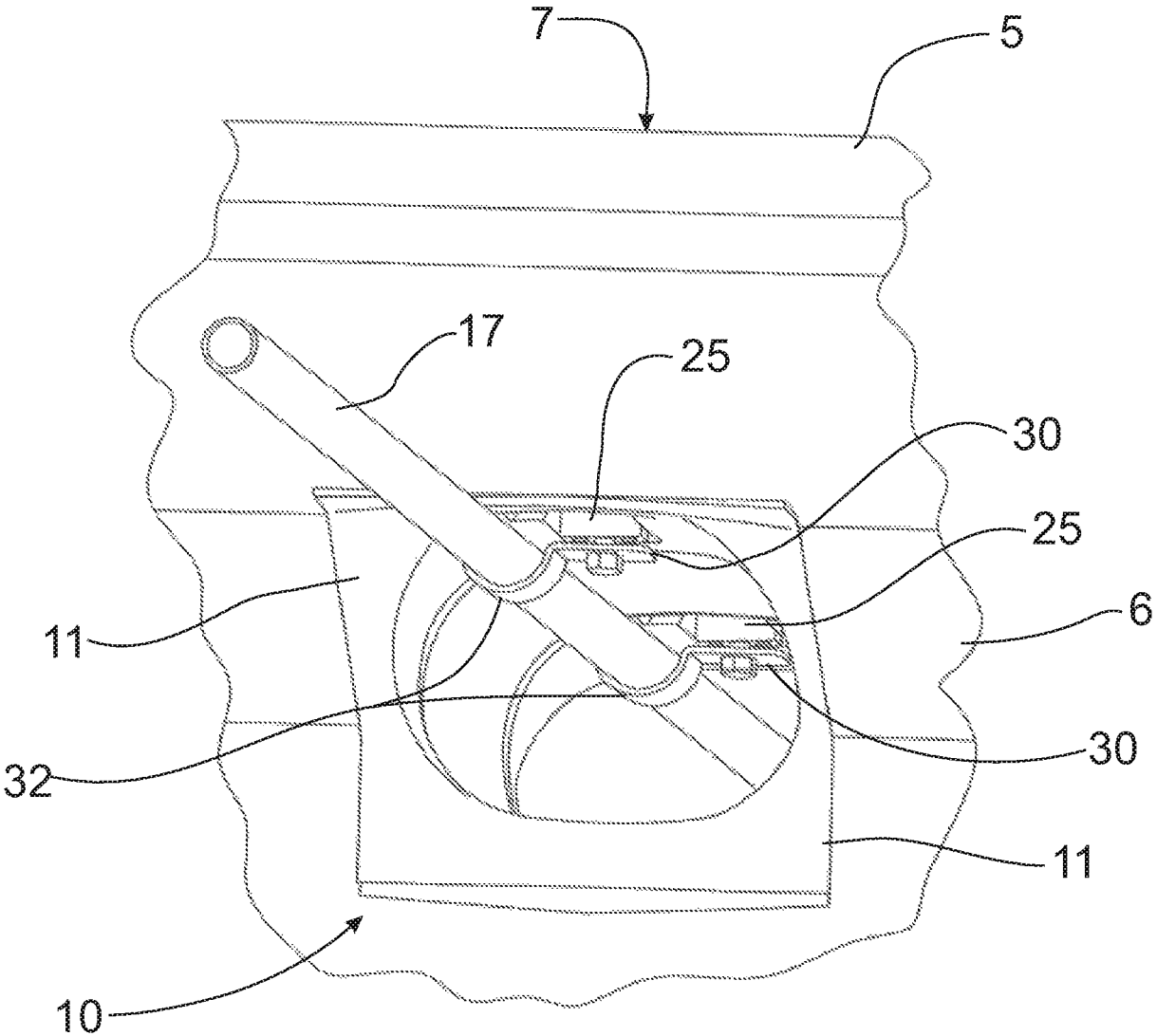
FIG. 7 is a perspective view of the blockout member installed within a concrete panel to create a void therethrough with wedge nuts inserted in the hanger members at both ends of the blockout member and having representative mounting devices affixed to the wedge nuts to support a conduit passing through the blockout member.

As is best seen in FIG. 6, the mounting device 30 has at least one curved member 32 sized to receive and support a particularly sized conduit 17 so that the conduit 17 becomes supported by the wedge nut 25 engaged with the hanger members 20. A fastener 33 is inserted through a mounting flange 34 of the mounting device 30 to threadably engage a threaded opening 29 in the wedge nut 25. As depicted in FIG. 5, the wedge nut 25 can be formed with multiple threaded openings 29 for support of multiple mounting devices 30 that support multiple of conduits 17 passing through the void created by the blockout member 10. Furthermore, each mounting device 30 can include multiple curved portions 32 for supporting a corresponding number of conduits 17.

Figure 9:
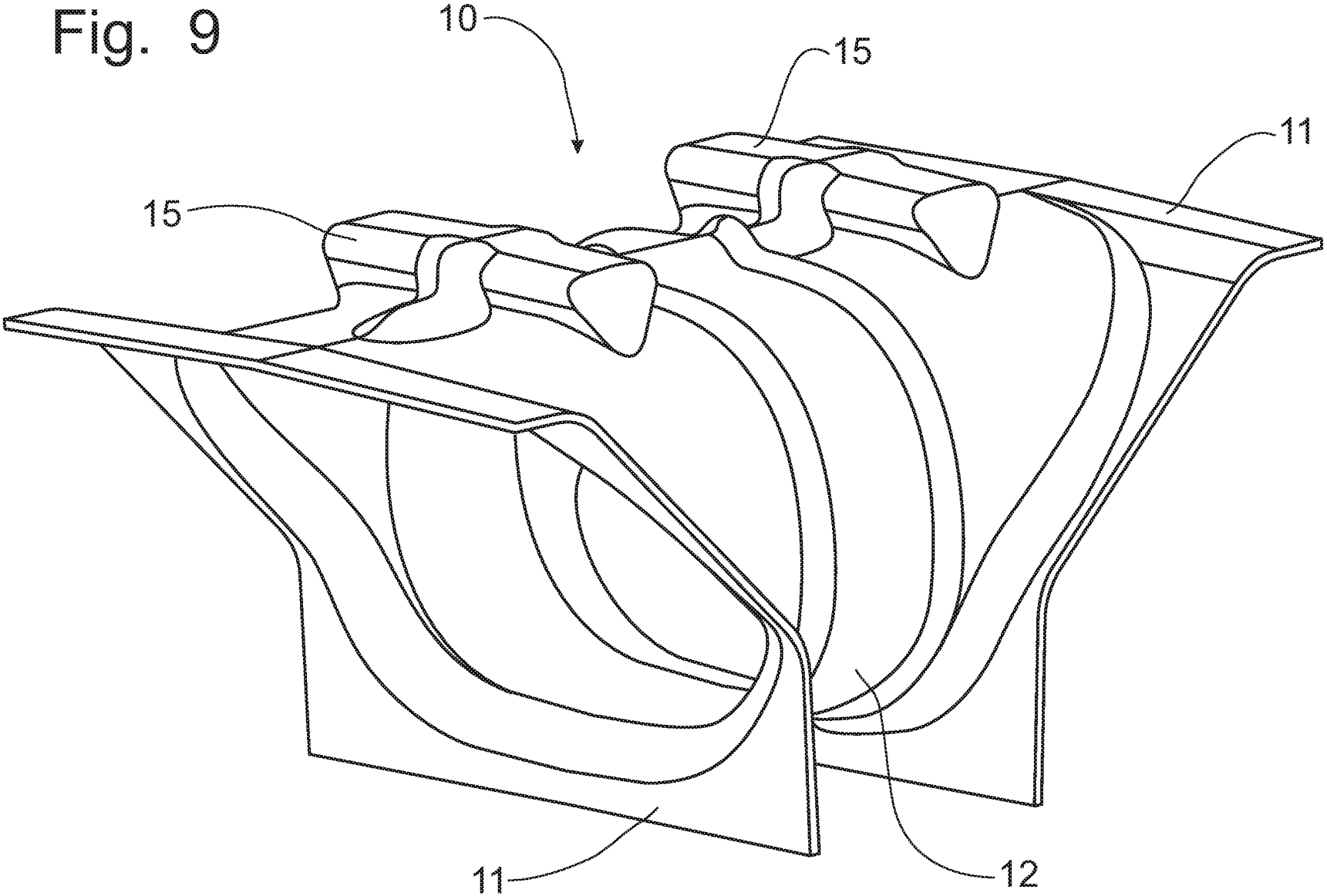
FIG. 9 is a perspective view of an alternative embodiment of a blockout member for installation into a Double-T prefabricated concrete panel.
Figure 10:
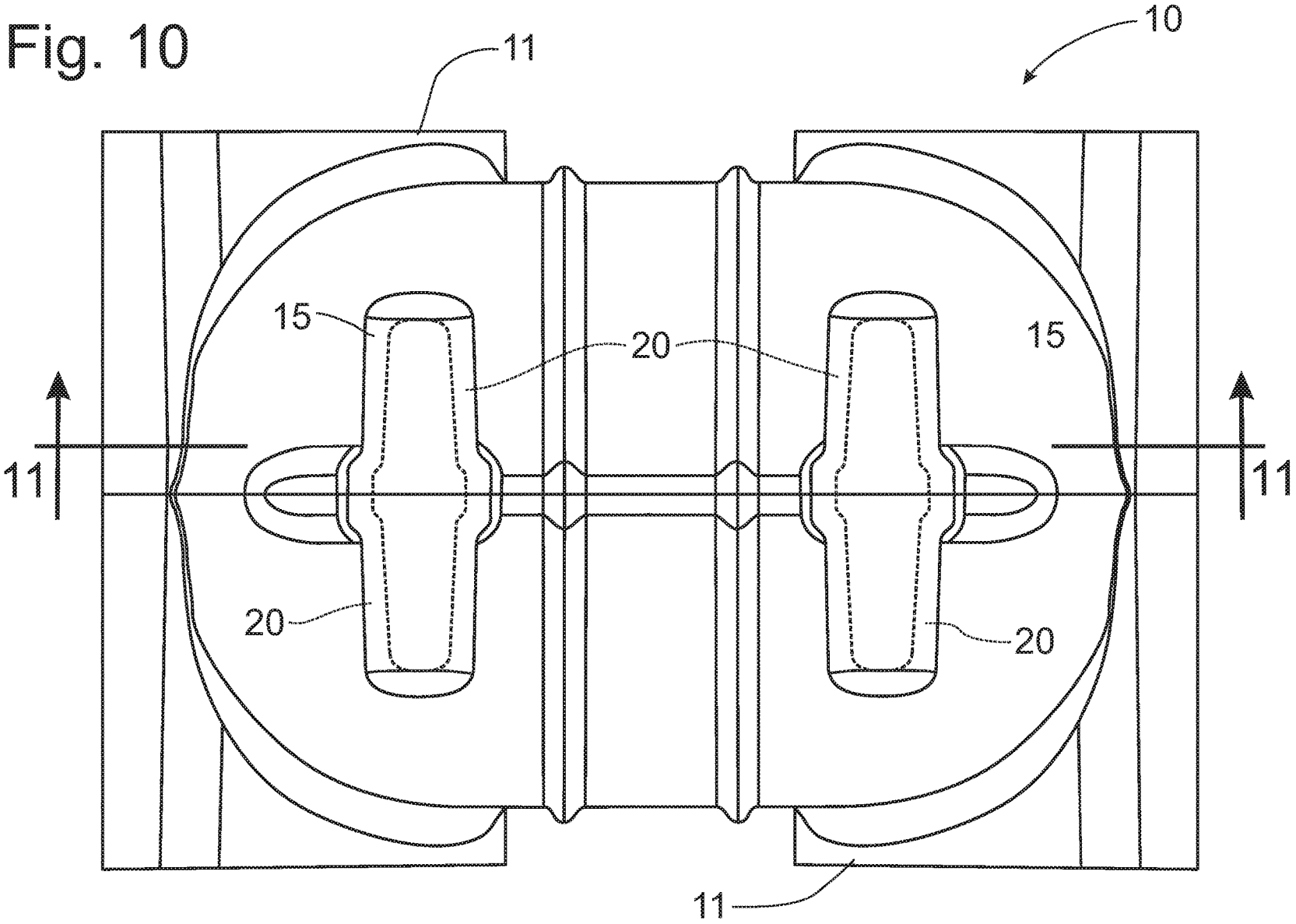
FIG. 10 is a top plan view of the blockout member shown in FIG. 10.
Figure 11:
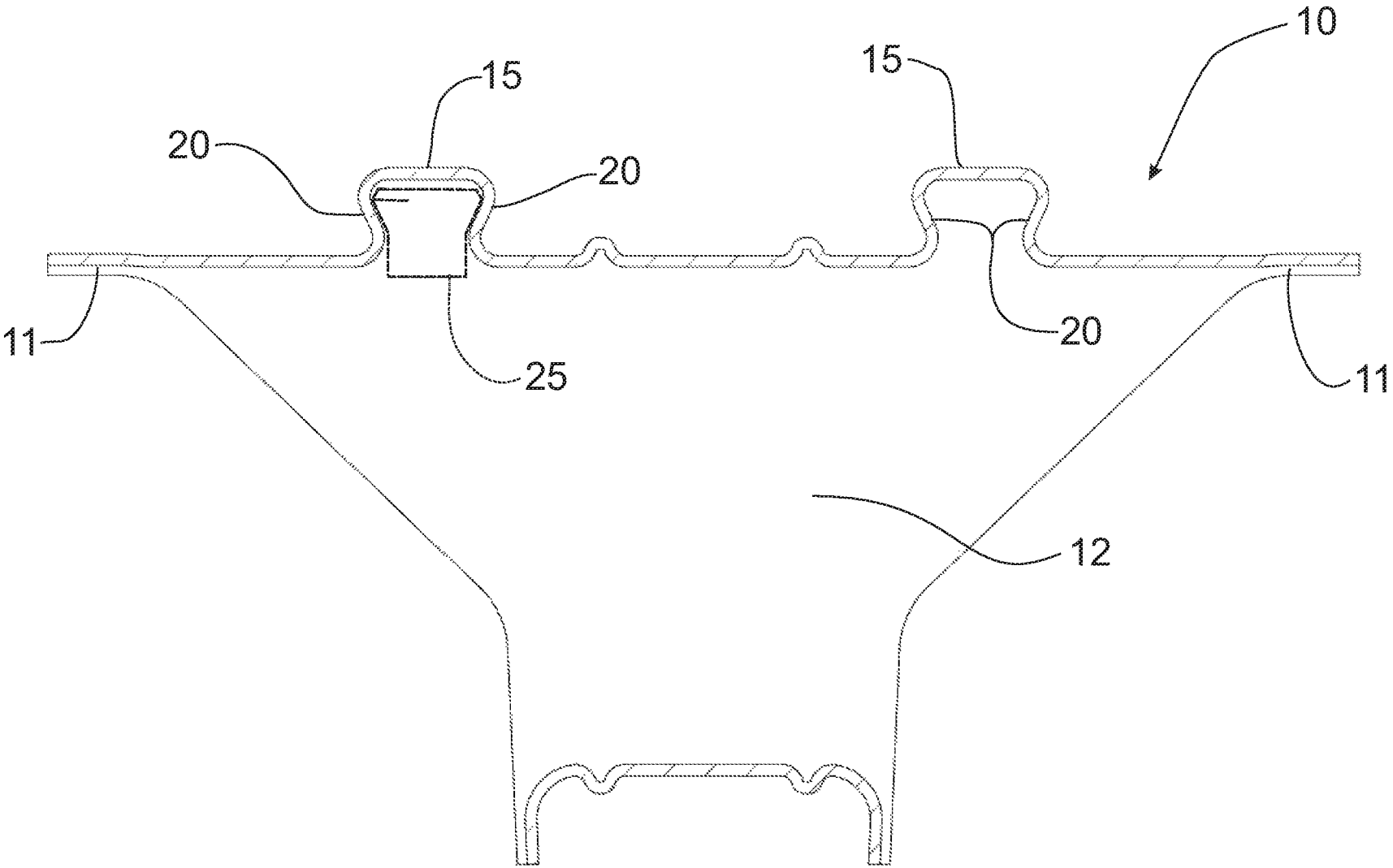
FIG. 11 is a cross-sectional view through the blockout member along the lines of 11-11 of FIG. 10.

Referring now to FIGS. 9-11, an alternative embodiment of a blockout member incorporating the principles of the instant invention can best be seen. The general shape of the body 12 of the blockout member 10 is substantially the same as that described above; however, the orientation of the dome portions 15 are oriented in a transverse direction rather than in a longitudinal direction along the major axis of the blockout member 10, as described above. The dome portions 15 are shaped in the same manner as the longitudinally oriented dome portions and incorporate hanger members 20 that are engagable by wedge nuts 25 to support a mounting device that, in turn, supports one or more conduits passing through the passageway formed by the blockout member 10. Since the dome portions 15 are integrally formed into the body 12 of the blockout member 10 when molded, the upper surface of the blockout member maintains integrity without any voids or openings that could leak uncured concrete mixture into the passageway of the blockout member 10 during manufacture of the concrete panel.

In operation, the blockout apparatus 10, with the hanger members 20 molded as part of the dome portion 15 projecting above the tubular body portion 12 of the blockout apparatus 10, is placed into the molding form for the construction of the prefabricated Double-T panel 5 before the uncured concrete is placed into the form. The form is filled with uncured concrete flowing around the blockout apparatus 10 so that the blockout apparatus 10 is incorporated into the Double-T panel 5. When the concrete mixture hardens, the blockout member 10 forms a void or passageway through the T-beams 6. The Double-T panel 5 is shipped to the job site and placed according to plan for the construction of a concrete structure, such as a parking garage in which the cars travel over the planar top surface 7 of the Double-T panels 5.

At some point, either prior to placement of the blockout apparatus 10 into the form of the Double-T panel 5, or at any point up to the time when support of a conduit 17 or other device passing through the passageway is needed, a wedge nut 25 is installed on the hanger members 20 by inserting the wedge nut 25 longitudinally into the dome portion 15 and then twisted into engagement with the hanger members 20 so as to have a transverse orientation, which locks the enlarged head portion 26 of the wedge nut 25 into engagement with the hanger members 20. In the second embodiment, the wedge nut 25 is inserted transversely and twisted to have a longitudinal orientation. The wedge nut 25 includes at least one vertically oriented threaded opening 29 facing downwardly toward the passageway so that a mounting device 30 can be affixed to the wedge nut 25. The mounting device 30 is connected to the wedge nut 25 by a fastener 33 threaded into the opening 29. A conduit 17 can be supported on the curved portion 32 of the mounting device 30.

Such installation of mounting members 30 throughout the aligned blockout members 10 along the intended path of the conduit 17 allows the conduit 17 to be supported beneath the Double-T panels 5 in conformance with building codes without requiring holes to be drilled into the concrete structure of the Double-T panel 5. Thus, the installation of mounting devices 30 for the support of conduits 17 can be quickly and easily accomplished, saving labor and material costs. Accordingly, the pre-installation work for supporting conduits 17 is not necessary.

The elevated dome portions 15 in the molding of the blockout apparatus 10 provides a uniform exterior surface for the blockout apparatus 10 so that when the blockout apparatus 10 is installed into the molding form for the fabrication of the Double-T panels 5, the exterior surface of the blockout apparatus 10 is without openings through which uncured concrete could pass into the interior of the blockout apparatus 10. The central positioning of the longitudinally extending dome portions 15 on the longitudinally extending major axis of the blockout apparatus 10 enables the incorporated hanger members 20 to locate mounting devices 30 for support of conduits 17 at essentially any location within the interior passageway of the blockout apparatus 10. The transverse orientation of the transversely extending dome portions 15 in the second embodiment shown in FIGS. 8-11 enables mounting devices 30 to be installed for the support of conduits at essentially any locations, and furthermore, the wedge nuts 25 in the second embodiment can be positioned laterally for positioning of the mounting devices 30 as desired.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form show.

For example, the dome portions could include a single dome portion that is positioned at one end of the body member or the other, or even in the middle. The length of the dome portion can extend from one end of the body member to the opposing end, or be a smaller discrete length.

Having thus described the invention, what is claimed is:

1. A blockout apparatus for installation into a prefabricated concrete structural member to create a passageway therethrough for the passage of conduits and other structural members, comprising:

a cylindrical tubular body member having a circumferentially closed configuration between first and second opposing ends defining said passageway having a longitudinal length dimension extending between said opposing ends, said tubular body member having an upper portion;

a pair of dome portions integrally formed with said tubular body member in said upper portion, each of said dome portions being located proximate to one of said opposing ends and having a length dimension smaller than said longitudinal length dimension of said tubular body member, each of said dome portions establishing an integral exterior surface with said upper portion without an opening exposing said interior passageway through said upper portion, each of said dome portions having an access opening facing said passageway; and each of said dome portions including opposing curved hanger members formed therein and being accessible through said access opening;

wherein a wedge nut is configured to be inserted into one of said dome portions and engage the hanger members of the respective dome portion.

2. The blockout apparatus of claim 1 further comprising;

a wedge nut engaged with said hanger members in at least one of said dome portions, said wedge nut including a threaded opening facing said passageway.

3. The blockout apparatus of claim 2 wherein said wedge nut has an enlarged head engagable with said hanger members and a tapered lower portion, said enlarged head being formed with opposing curved surfaces to facilitate engagement of said enlarged head with said hanger members.

4. The blockout apparatus of claim 2 further comprising:

a mounting device including a fastener threaded into said threaded opening in said wedge nut and including at least one curved member that can support a conduit extending through said passageway.

5. The blockout apparatus of claim 4 wherein said dome portions are oriented longitudinally along said body member and located along a longitudinal centerline of said upper portion.

6. The blockout apparatus of claim 4 wherein said each dome portion is oriented transversely with respect to said body member generally perpendicularly to a longitudinal centerline of said upper portion.

7. A blockout apparatus for installation in a molding form for constructing a prefabricated concrete structural member, comprising:

a cylindrical tubular body member having a circumferentially closed configuration and having opposing ends defining a passageway extending along a longitudinal length dimension of said tubular body member between said opposing ends, said tubular body member having an upper portion;

at least one dome portion integrally formed in said upper portion of said tubular body member and having a length less than said longitudinal length dimension of said tubular body member, said at least one dome portion establishing an integral exterior surface with said upper portion, said at least one dome portion having an access opening facing said passageway extending between said opposing ends;

curved opposing hanger members formed as part of said at least one dome portion, said hanger members being molded into said at least one dome portion and being accessible through said access opening; and a wedge nut having an enlarged head engaged with said hanger members and including at least one vertically oriented threaded opening facing said passageway, said enlarged head having a width dimension allowing the wedge nut to be inserted into said access opening and a length dimension that engages the hanger members when said wedge nut is rotated.

8. The blockout apparatus of claim 7 further comprising:

a mounting device threaded into said threaded opening in said wedge nut, said mounting device including a curved member operable to support a conduit extending through said passageway.

9. The blockout apparatus of claim 7 wherein said at least one dome portion comprises a first dome portion at one end of said tubular body member, and a second dome portion at the opposing end of said tubular body member.

10. The blockout apparatus of claim 9 wherein said first and second dome portions are oriented longitudinally with respect to said tubular body portion of said blockout member and are centrally located on said tubular body portion.

11. The blockout apparatus of claim 9 wherein said first and second dome portions are oriented transversely with respect to a major axis of said tubular body portion of said blockout member.

12. The blockout apparatus of claim 9 wherein each of said opposing ends is formed with a flange extending around the corresponding end of said tubular body member to mate with the form in which the blockout apparatus is installed before the fabrication of said concrete structural member.

13. The blockout apparatus of claim 12 wherein said concrete structural member is a Double-T panel having T-beams projecting downwardly from a planar top surface, said tubular body member being located within each of said T-beams to provide said passageway therethrough.

14. A blockout apparatus for installation in a form for constructing a prefabricated concrete Double-T panel with said blockout apparatus being located within a T-beam member, comprising:

a cylindrical tubular body member having a circumferentially closed configuration between first and second opposing ends defining an interior passageway extending along a longitudinal length dimension between said first and second opposing ends, said tubular body member having an exterior surface, including an exterior surface on an upper portion of said tubular body member, said tubular body member further including an interior surface extending around said passageway;

at least one dome portion integrally formed with said tubular body member on said upper portion and having a length dimension smaller than said longitudinal length dimension of said interior passageway, said at least one dome portion being incorporated integrally into said exterior surface of said upper portion without an opening exposing said interior passageway through said upper portion, said at least one dome portion having an access opening in said interior surface facing said passageway;

each of said at least one dome portion forming opposing curved hanger members, said hanger members being accessible through said access opening; and a wedge nut having an enlarged head engaged with said hanger members and including at least one vertically oriented threaded opening facing said passageway, said enlarged head having a width dimension allowing the wedge nut to be inserted into said access opening and a length dimension that engages the hanger members when said wedge nut is rotated for engagement with said hanger members.

15. The blockout apparatus of claim 14 wherein a mounting device is threaded into said threaded opening in said wedge nut and includes at least one curved member that can support a conduit extending through said passageway.

16. The blockout apparatus of claim 15 wherein said at least one dome portion comprises a first dome portion at one end of said tubular body member, and a second dome portion at the opposing end of said tubular body member.

17. The blockout apparatus of claim 16 wherein each of said opposing ends is formed with a flange extending around the corresponding end of said tubular body member to mate with the form in which the blockout apparatus is installed before the fabrication of said concrete structural member.

18. The blockout apparatus of claim 16 wherein said first and second dome portions are oriented longitudinally in alignment with a major axis of said body portion.

19. The blockout apparatus of claim 16 wherein said first and second dome portions are oriented transversely perpendicular to a major axis of said body portion.

* * * * *